US005397122A

United States Patent [19]

Herridge, II

[11] Patent Number: 5,397,122

[45] Date of Patent: Mar. 14, 1995

[54] GOLF CLUB SWING CONNECTING DEVICE

[76] Inventor: Bert T. Herridge, II, 10819 Highpoint, Montgomery, Tex. 77356

[21] Appl. No.: 202,479

[22] Filed: Feb. 28, 1994

[51] Int. Cl.[6] ..... A63B 69/36

[52] U.S. Cl. ..... 273/189 R; 273/188 A

[58] Field of Search ..... 273/35 R, 187.2, 188 R, 273/189 R, 190 B, 191 B, 188 A, 26 C, 29 A, 1.5 A; 482/20, 21, 22, 121, 124, 125; 602/4, 20, 230; 2/230, 309, 310, 311; 473/59, 63

[56] References Cited

U.S. PATENT DOCUMENTS

| | | | |
|---|---|---|---|
| 2,498,006 | 2/1950 | Ridill | 482/124 |
| 2,773,691 | 12/1956 | Redfield | 273/189 |
| 3,679,214 | 7/1972 | Boyte | 273/189 R |
| 3,740,052 | 6/1973 | Arkin | 273/189 |
| 4,359,221 | 11/1982 | Taylor | 273/189 R |
| 4,626,549 | 5/1977 | Gunn | 482/124 |
| 4,691,924 | 9/1987 | Strong | 273/189 |
| 4,892,317 | 1/1990 | Corder | 273/183 |
| 5,149,099 | 9/1992 | Radakovich | 273/189 |
| 5,188,365 | 2/1993 | Picard | 273/189 |

FOREIGN PATENT DOCUMENTS

| | | | |
|---|---|---|---|
| 0020463 | of 1907 | United Kingdom | 273/189 R |
| 0180599 | 6/1922 | United Kingdom | 273/189 R |
| 0451516 | 8/1936 | United Kingdom | 482/124 |

*Primary Examiner*—V. Millin
*Assistant Examiner*—William M. Pierce
*Attorney, Agent, or Firm*—Mary J. Gaskin

[57] ABSTRACT

A golf club swing training device and method comprising a length of elastic tubing formed so that an upper loop encircles the upper arm of the golfer and the lower loop is attached at the waist on the golfer's side. Two such devices may be used, one on the golfer's target-side and one on his trail-side. When the golfer's backswing is correct, the trail-side device will not stretch or pull; when the golfer's forward swing is correct, the target-side device will not stretch or pull.

4 Claims, 4 Drawing Sheets

GOLF CLUB SWING CONNECTING DEVICE

BACKGROUND OF THE INVENTION

This invention relates to a device for ensuring the proper connection of the golfer's arms during the golf club swing, thereby enhancing the golfer's ability to make accurate golf shots.

Numerous inventions have been developed to aid golfers in developing more accurate and consistent golf swings. Many of these involve rigidly-connected bands about the arms and torso of the golfer. Others involve connecting the arms, the legs and/or the golf club.

During the last twenty years, the proper body position for the golf swing has changed from an inverted C body position to a balanced up position, and the main focus is on balance and connection. A golfer might have excellent balance but poor connection of the arms during the golf swing, leading to inconsistent shot-making. Disconnection of the golfer's "trail-side" elbow during the backswing (commonly referred to as the "flying elbow") occurs. Disconnection of the arms during either the backswing or the forward swing leads to a change in the golf swing plane, and that change leads to missed shots and shots that travel off the intended target line.

Accordingly, it is an object of the present invention to train golfers' muscle memory as to the proper position of the golfer's arms in connection with the torso during a good golf swing;

Another object of the invention is to provide a resilient device whose pull and stretch, or lack thereof, will provide feedback that the position of the arms during the golf swing is incorrect or correct.

It is yet another object of the invention to provide a comfortable training device which can be used in pairs, each of which is easily pulled over the upper arm and conveniently attached to a belt loop.

A further object of the invention is to provide a safe golf swing training device which does not bind against the upper arms or any other part of the golfer's body.

A still further object of the invention is to provide a golf swing training device which is relatively inexpensive and completely portable.

SUMMARY OF THE INVENTION

The present invention was developed to address the need for an adjustable, golf-swing connecting device which would be both convenient and effective in training the golfer's muscles which are used during the golf swing.

Two identical and interchangeable devices are employed. The devices are easily placed on and removed from the golfer's upper arms. Each adjustable golf swing connecting device has two flexible, adjustable bands, or loops. The upper band of one of the devices encircles the upper arm on the golfer's target side (the side of the body closest to the target while at address). The lower band is attached to the belt loop on the golfer's target side. The other device is attached to the golfer's trail side (the side of the body farthest from the target while at address) in the same manner as that described for the target side.

An upper adjusting clamp and a lower adjusting clamp allow for adjustment of the size of each of the bands of each of the devices. The golfer adjusts the upper arm band so it fits snugly over his upper arm area. Next, the snap swivel is attached to the proper belt loop.

The player stands in an address position with his arms hanging down naturally. Proper slack adjustment will be snug from the waist area to the upper arm area. Adjustments can be made at the lower band end by detaching the snap swivel, removing slack, and reattaching the snap swivel to the belt loop.

The device on the target side and the device on the trail side work independently of each other. When used together, the devices enable the golfer to feel the proper arm position needed for a connected swing which will make the golf club stay on the proper swing plane. If the player's arms become disconnected during the backswing, the player will feel stretching or pulling on the trail-side devices; if his arms become disconnected during the forward swing, the player will feel stretching or pulling on the target-side device. Over time, the golfer's muscles become trained to the proper feel and memory of a good golf swing, and the golfer develops the ability to repeat a good golf swing to make good shots.

The device may be used by right- and left-handed male and female golfers of all sizes and ability levels.

DESCRIPTION OF THE PREFERRED EMBODIMENT

Each of the golf swing connecting devices shown in FIGS. 1–4 comprise a length of flexible, resilient tubing 1, upper adjusting member 3, lower adjusting member 4, and a snap swivel attachment 6. The tubing 1 is formed of a material such as latex surgical tubing or rubber tubing with a circular, open cross-section. The upper adjusting member 3 and the lower adjusting member 4 are similar in construction and are formed of metal or hard plastic; both members are designed to accommodate the insertion of two lengths of tubing 1, side by side. The snap swivel attachment 6 is made of chromed steel, for example; it comprises a ring, a swivel, and a snap, which is used to anchor the golf swing connecting device to the waist area of the golfer.

Figure 1:
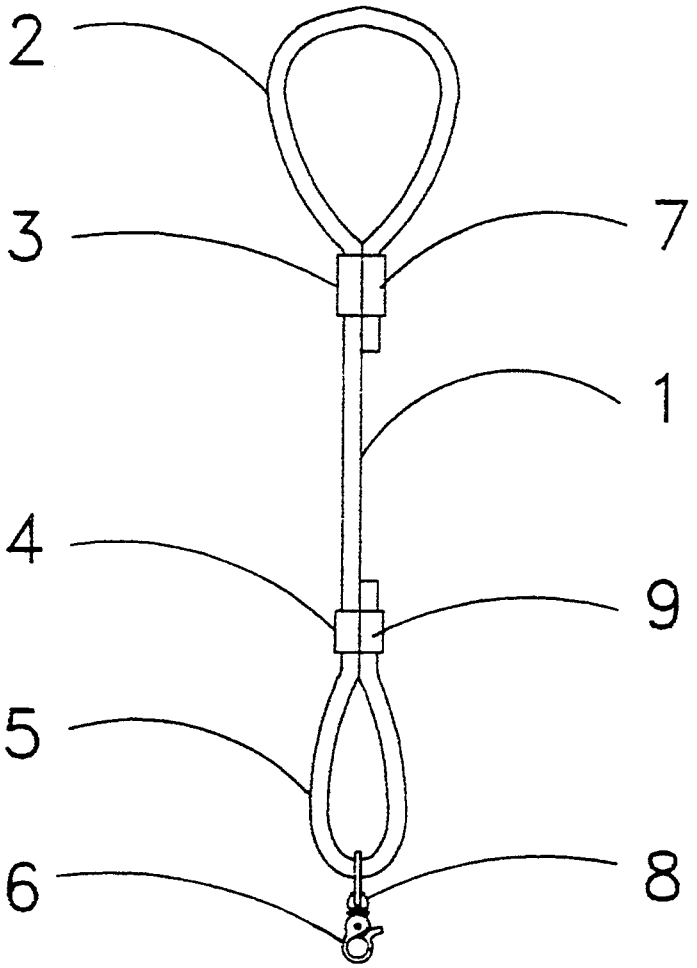
FIG. 1 illustrates a side view of one of the golf swing connecting devices.

As shown in FIG. 1, the upper portion of the tubing 1 has been inserted upwardly (easily, but not loosely) through the opening in the left-hand side of upper adjusting member 3, upper loop end 2 has been formed, and the end of the upper portion of the tubing 1 has been returned to the upper adjusting member 3 and inserted downwardly through the opening of the right-hand side of upper adjusting member 3; the entire right hand portion 7 of the upper adjusting member 3 has then been crimped, or compressed, with a vise or press in order to anchor the upper end of tubing 1.

The lower portion of the tubing 1 has been inserted downwardly through the opening in the right-hand side of lower adjusting member 4, lower loop end 5 has been formed, and the end of the lower portion of the tubing 1 has been inserted through the open ring 8 of the snap swivel 6, and then returned to the lower adjusting member 4 and inserted upwardly through the opening in the right-hand side of lower adjusting member 4; the entire right-hand portion 9 of lower adjusting member 4 has then been crimped, or compressed with a vise or press, in order to anchor the lower end of the tubing 1.

The size of the upper loop end 2 and lower loop end 5 can be changed by pulling tubing 1 through the uncrimped side of upper adjusting member 3 and lower adjusting member 4. After adjustments are made, the crimping° of one side of each of the adjusting members 3 and 4, as well as the friction created by the action of latex against latex, will ensure that the tubing will not slip through the adjusting members 3 and 4 during the golf swing. However, the size of the upper loop end 2 and lower loop end 5 can be readjusted after use, again by pulling the tubing 1 through the uncrimped sides of the adjusting members 3 and 4.

Figure 2:
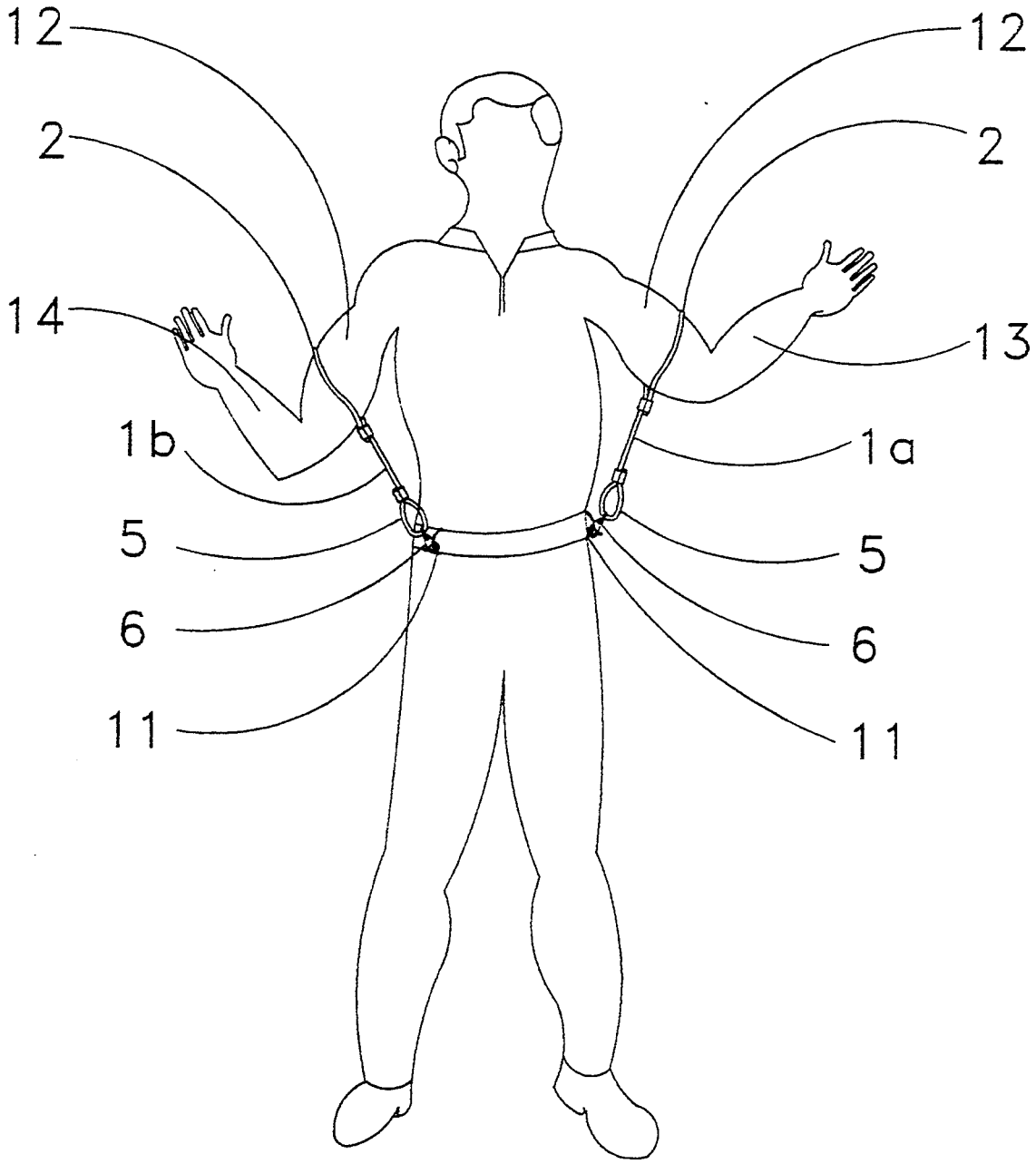
FIG. 2 is a front view of a golfer wearing two golf swing connecting devices, one on the target side and one on the trail side of his body.

In practice or play, the golfer will wear two golf swing connecting devices, as shown in FIG. 2. The upper loop end 2 of each device has been fitted around each of the golfer's upper arm areas 12. The lower loop end 5 of each device is anchored to the side belt loop 11 closest to that arm by snap swivel attachment 6. The tubing 1 that is attached to the target arm 13 (the left arm for a right-handed golfer) is shown as la; the tubing 1 that is attached to the trail arm 14 (the right arm for a right-handed golfer) is shown as lb.

Wearing both golf swing connecting devices, the golfer stands in an address position with his arms hanging down naturally. Both devices should feel snug from the waist area to the upper arm area. Adjustments in size of the upper loop ends 2 and lower loop ends 5 can be made.

Figure 3:
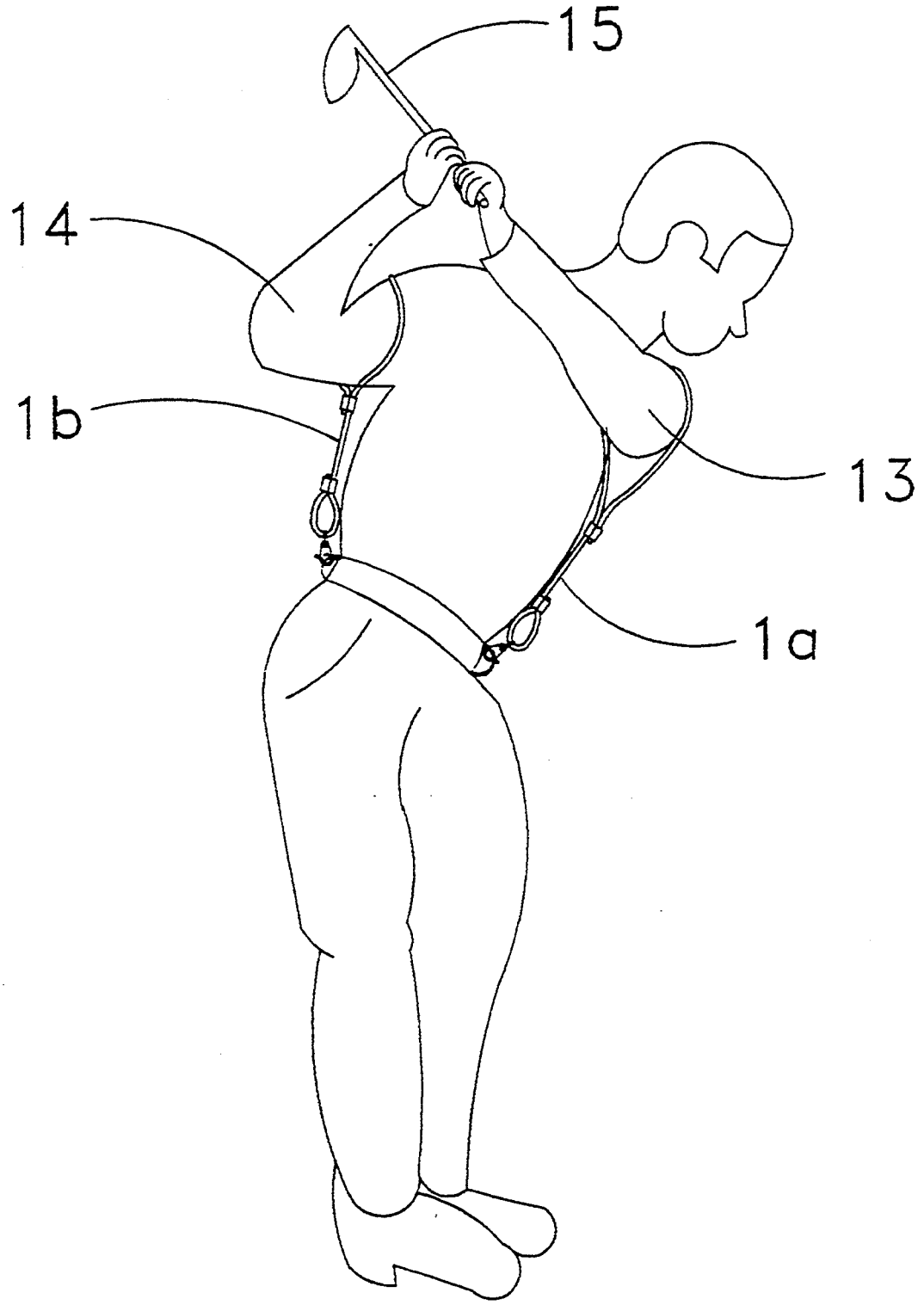
FIG. 3 is a side perspective view of a golfer at the completion of his back swing, showing the position of the two golf swing connecting devices.

FIG. 3 shows the proper connected position of the right-handed golfer's target arm 13 and trail arm 14 at the top of the backswing of the golf club 15. The trail-side tubing 1*b* is not pulling or stretching; therefore, no "flying elbow" will take place, assuring the golf club 15 is on plane. The target-side tubing 1*a* is stretching up and across the golfer's chest area to maintain the connected arm position.

Figure 4:
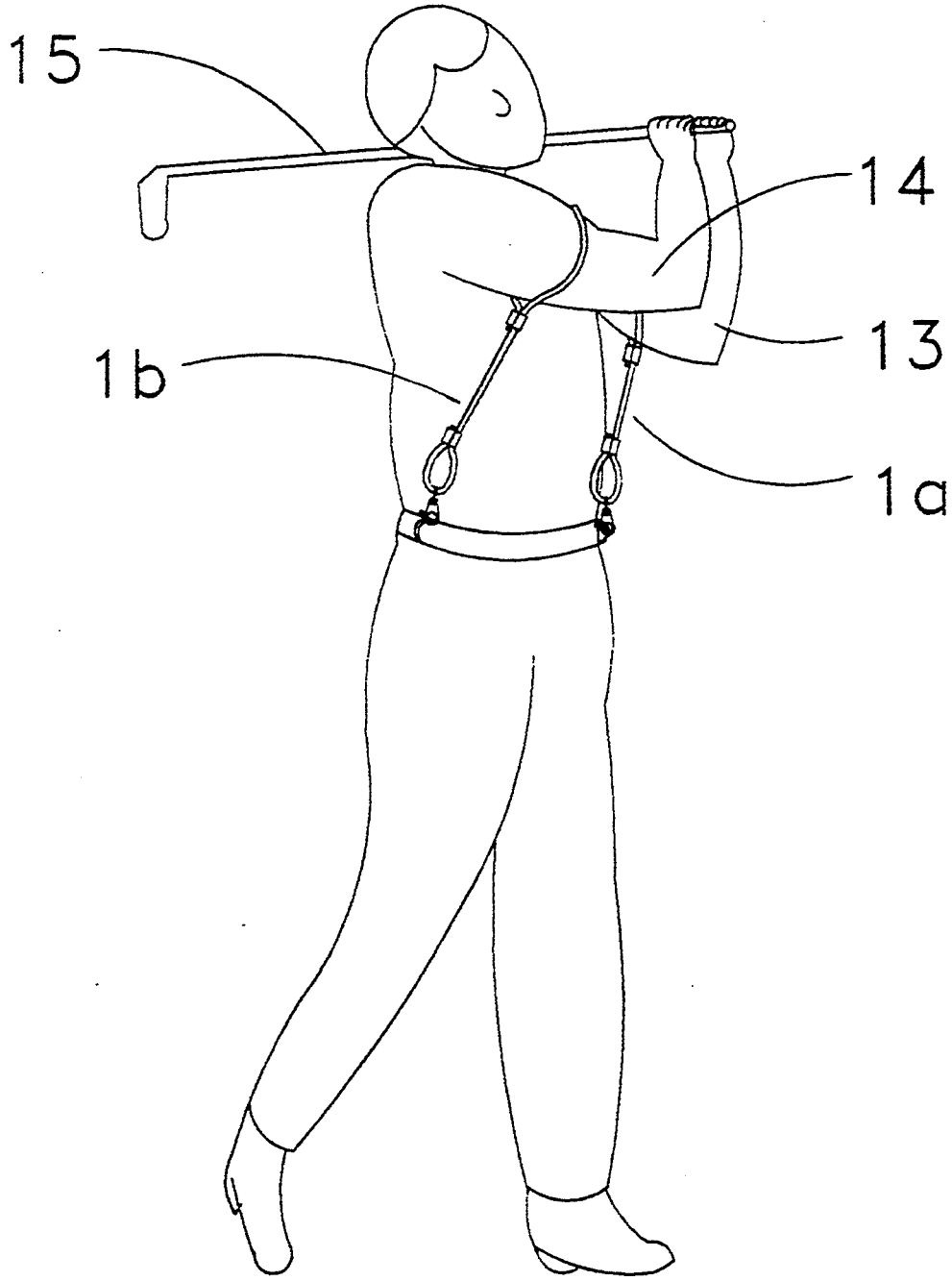
FIG. 4 is a front view of a golfer at the completion of his forward swing, showing the position of the two golf swing connecting devices.

FIG. 4 shows the proper balanced and connected finish for the swing of the golf club 15. The target arm 13 and the trail arm 14 are in a connected position. The target-side tubing 1*a* is not stretching or pulling, ensuring that the elbow of target arm 13 is in the correct connected position. The trail-side tubing 1*b* is stretching, ensuring that the trail side of the body has turned properly through the swing to balance.

The golf swing connecting devices allow the player to feel the proper connected arm position, such that the golfer's arms are kept in proper connection to the torso, throughout the golf swing. If the golfer feels pulling or stretching at the wrong time, he will know the swing is improper. Over time, muscle memory training will enable the golfer to make proper golf swings, even when he is not wearing the golf swing connecting devices.

What is claimed is:

1. A device for training a golfer to achieve proper connection of his/her arms in relationship to his/her upper torso during his/her backswing and forward swing, said device comprising:

(1) a single length of elastic tubing;

(2) an upper adjusting member, a section of said upper adjusting member adjustably encircling said elastic tubing at a location along an upper length thereof and a different section of said upper adjusting member crimping an upper end of said elastic tubing, said upper adjusting member forming the upper portion of said elastic tubing into an upper loop adjustable in size, said upper loop adapted to encircle an upper arm area of a golfer;

(3) a lower adjusting member, a section of said lower adjusting member adjustably encircling said elastic tubing at a location along a lower length thereof and a different section of said lower adjusting member crimping a lower end of said elastic tubing, said lower adjusting member forming a lower portion of said elastic tubing into a lower loop adjustable in size;

(4) securing means movably encircling a portion of said lower loop;

(5) anchoring means adapted to be located at a waist area of golfer;

(6) means for detachably attaching said securing means to said anchoring means.

2. A device as set forth in claim 1 wherein said anchoring means are side belt loops on a waistband capable of encircling the waist of the golfer.

3. A device as set forth in claim 1, wherein said anchoring means are side loops on a belt capable of encircling the waist of the golfer.

4. A method for assisting a golfer in learning the proper connection of his/her arms in relationship to his/her upper torso during his/her backswing and forward swing, comprising the steps of:

(1) providing a trail-side device including a length of elastic material between an upper elastic loop and a lower elastic loop, and a securing means attached to said lower elastic loop, said securing means for detachably anchoring said lower elastic loop to a trail-side belt area of a golfer's body;

(2) pulling said upper elastic loop around the upper area of a golfer's trail-side arm;

(3) adjusting the size of said upper elastic loop;

(4) attaching said securing means to the belt area on the trail-side of the golfer's body;

(5) adjusting the size of said lower elastic loop;

(6) Performing a backswing so that said trail-side device does not pull or stretch;

(7) providing a target-side device identical to that described in step (1), including a length of elastic material between an upper elastic loop and a lower elastic loop, and a securing means attached to said lower elastic loop, said securing means for detachably anchoring said lower elastic loop to a target-side belt area of said golfer's body;

(8) pulling said upper elastic loop of the target-side device around an upper area of a golfer's target-side arm;

(9) adjusting the size of said upper elastic loop;

(10) attaching said securing means of said target-side device to the belt area on the target-side of the golfer's body;

(11) adjusting the size of said lower elastic loop of said target-side device;

(12) performing a forward golf swing so that said target-side device does not pull or stretch.

* * * * *